United States Patent [19]

Clift et al.

[11] 4,215,522

[45] Aug. 5, 1980

[54] CARTON ERECTING APPARATUS

[75] Inventors: Gunther K. Clift, Tiptree; David Young, Chelmsford; Brian S. Fix, Goldhanger Nr. Maldon, all of England

[73] Assignee: Cundell Corrugated Limited, Chelmsford, England

[21] Appl. No.: 950,165

[22] Filed: Oct. 10, 1978

[30] Foreign Application Priority Data

Oct. 11, 1977 [GB] United Kingdom ..... 42272/77

[51] Int. Cl.[2] ..... B65B 7/18

[52] U.S. Cl. ..... 53/378; 53/284; 53/374; 93/39.1 P; 93/44.1 GT

[58] Field of Search ..... 53/284, 374, 375, 378; 93/39.1 R, 39.1 P, 36.8, 44.1 GT

[56] References Cited

U.S. PATENT DOCUMENTS

| | | | |
|---|---|---|---|
| 3,347,017 | 10/1967 | Allen et al. | 53/375 X |
| 3,579,958 | 5/1971 | Hentges et al. | 93/44.1 GT |
| 4,041,675 | 8/1977 | Loveland et al. | 53/374 X |

*Primary Examiner*—Travis S. McGehee
*Attorney, Agent, or Firm*—Charles E. Brown

[57] ABSTRACT

Cartons of the leakproof type comprising a rectangular sleeve each end of which is formed with crease lines to present four closure wall portions or flaps, two of said flaps being further provided with crease lines defining triangular portions to provide gussets, are closed by apparatus comprising means for holding a carton in position for closure, a pair of angularly movable pressure plates adapted to engage the triangular portions of the end wall flaps and to partially fold inwardly the end and side wall flaps, a pair of spaced pressure rods to further fold inwardly the end and side wall flaps so that the free ends of the side wall flaps are in overlapping engagement, and a pressure bar provided to engage the overlapping side wall flaps along a previously applied line of adhesive. A reaction plate may be provided to co-act with the pressure bar. The end closure apparatus may be incorporated in an installation for filling and closing cartons.

11 Claims, 7 Drawing Figures

CARTON ERECTING APPARATUS

This invention relates to apparatus for closing knock-down cartons, and to an installation incorporating such apparatus.

The invention is applicable to knock-down cartons of the leakproof type (hereinafter referred to as being of the type described) comprising a rectangular sleeve each end of which is formed with crease lines to present four closure wall portions or flaps, two of said wall portions or flaps being further provided with crease lines defining triangular portions to provide gussets.

According to the present invention there is provided apparatus for closing knock-down cartons of the type hereinbefore described having, at each end thereof, two oppositely disposed side wall flaps and two oppositely disposed end wall flaps having crease lines defining triangular portions to provide gussets, the apparatus comprising a pair of oppositely disposed carton side gripping devices, a pair of oppositely disposed angularly movable pressure plates adapted to engage the triangular portions of the end wall flaps and to partially fold inwardly the end wall flaps and the side wall flaps, a pair of spaced apart pressure rods adapted to engage the partially folded-in side wall flaps and to further fold inwardly the side and end flaps so that the free ends of the side flaps are in overlapping engagement, and a pressure bar adapted to engage the overlapping free ends of the side flaps along a previously applied line of adhesive.

Figure 1:
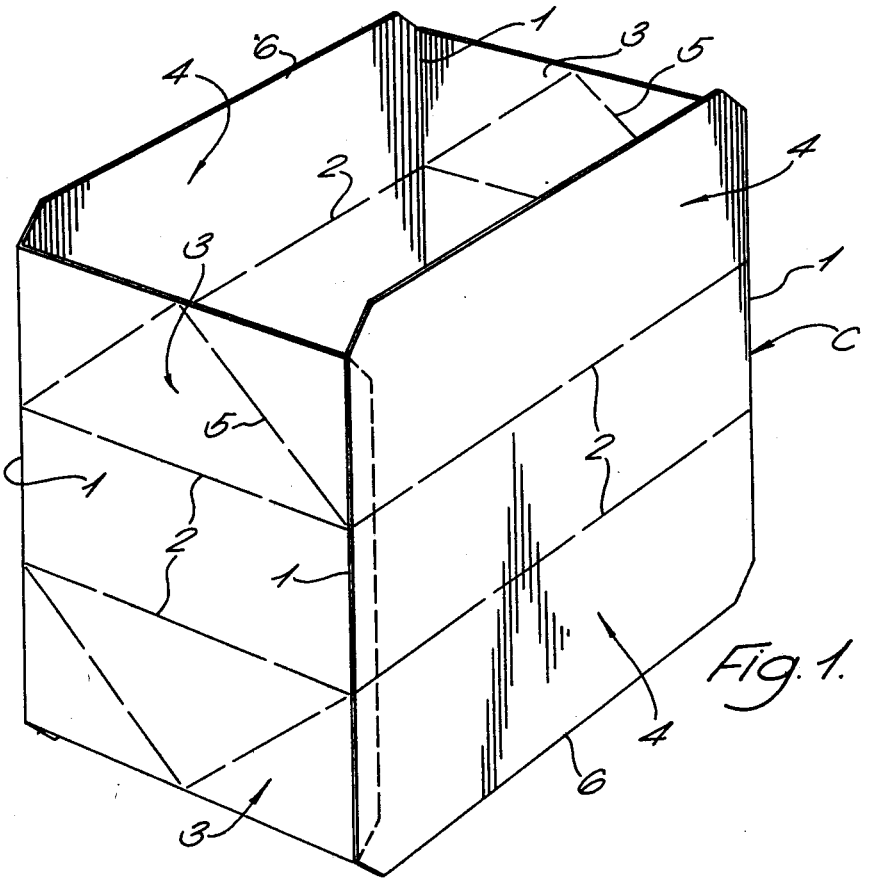
Figure 2:
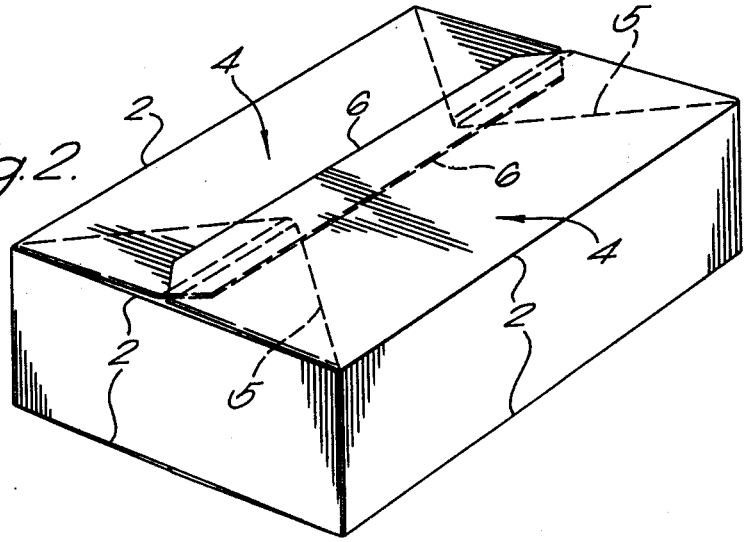
Figure 3:
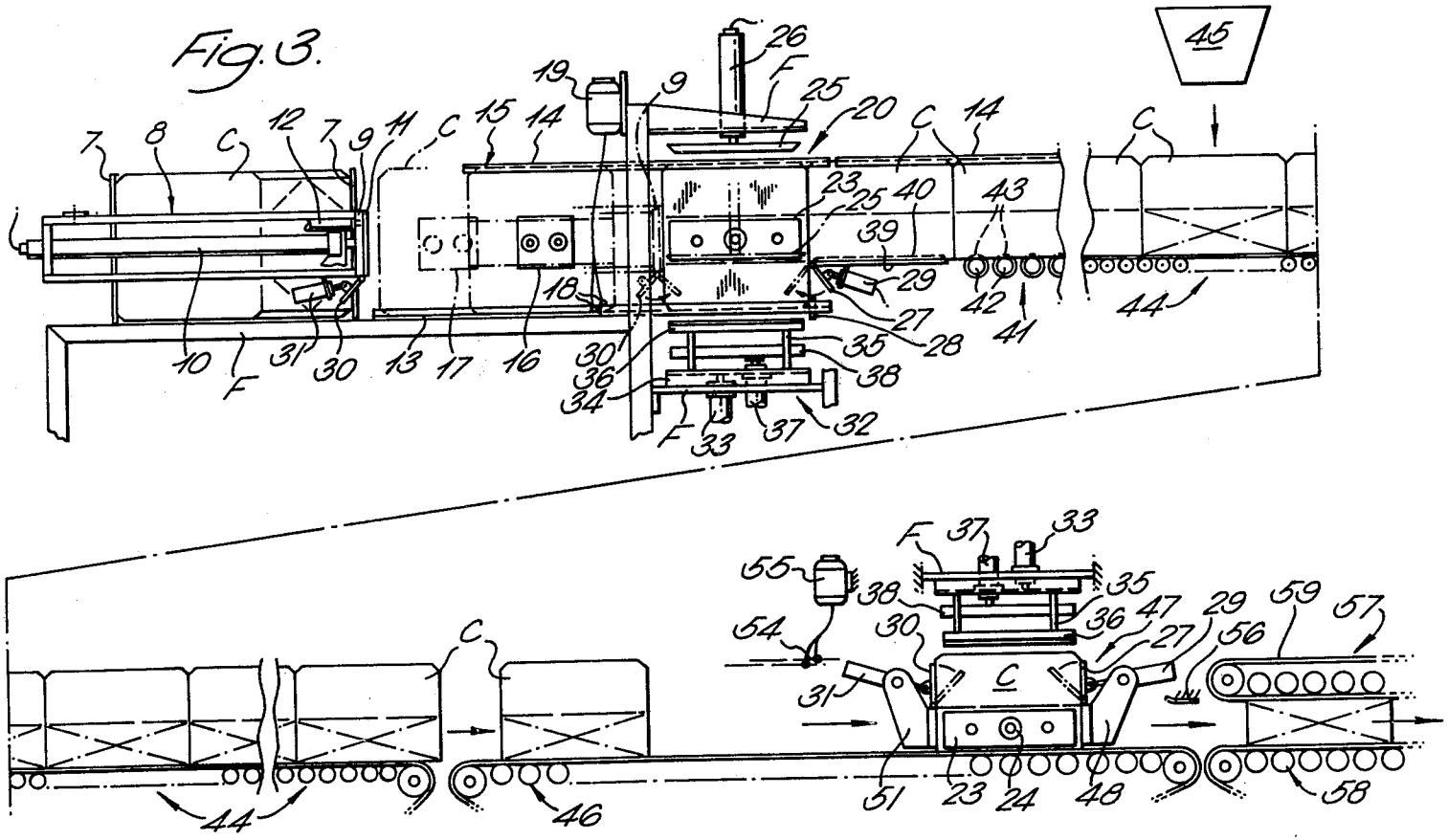
Figure 4:
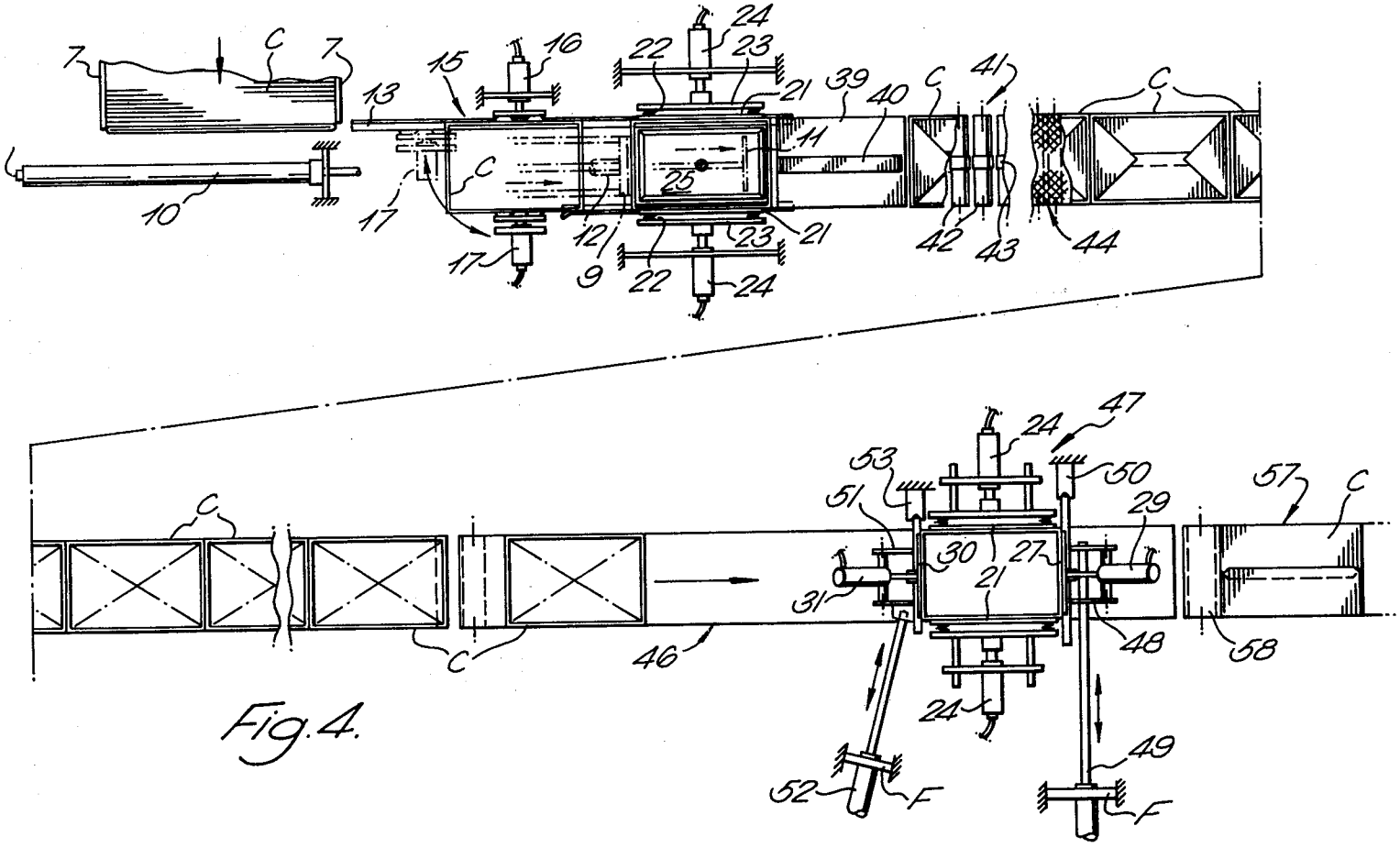
Figure 5:
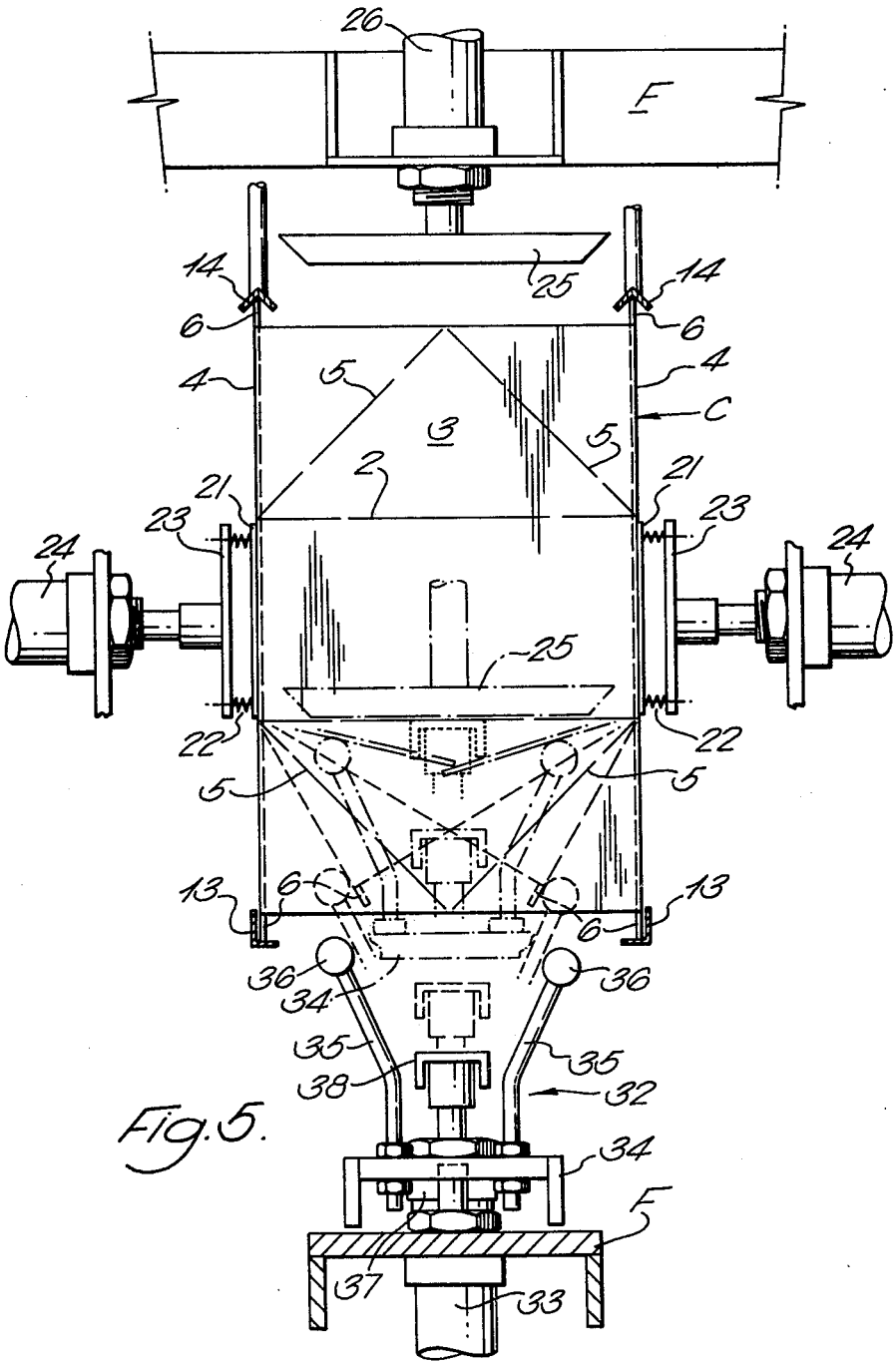
Figure 6:
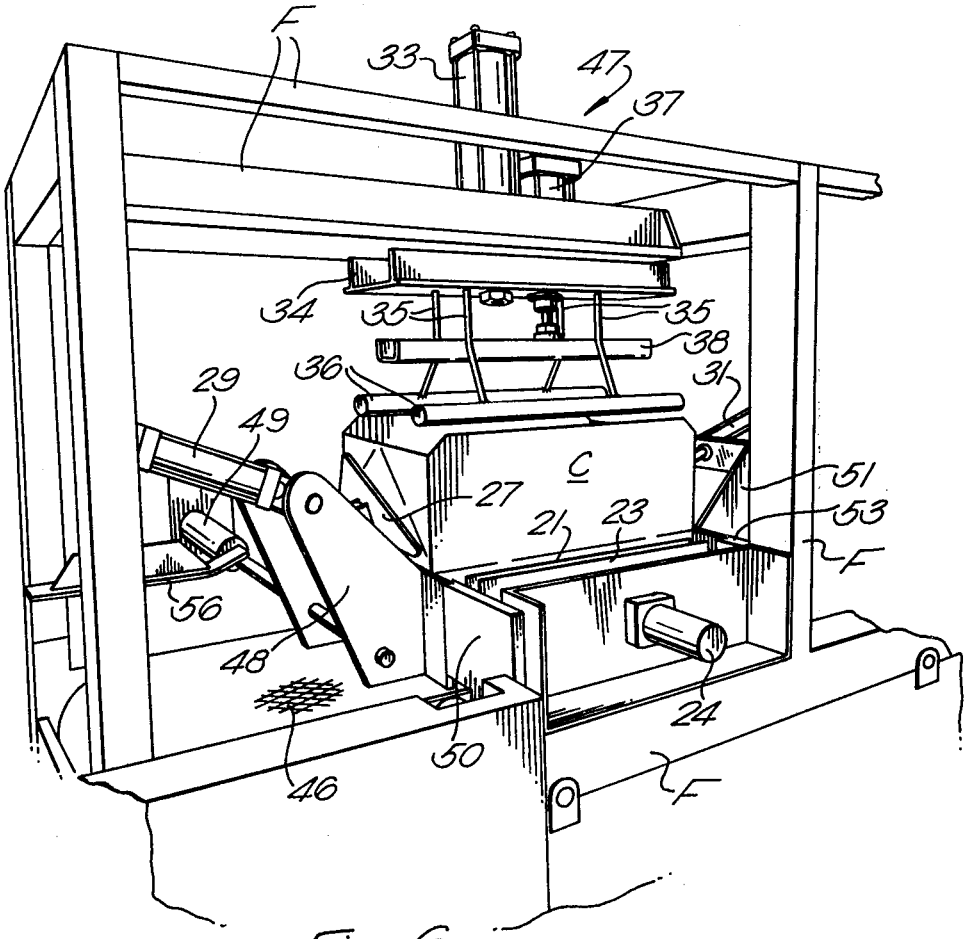
Figure 7:
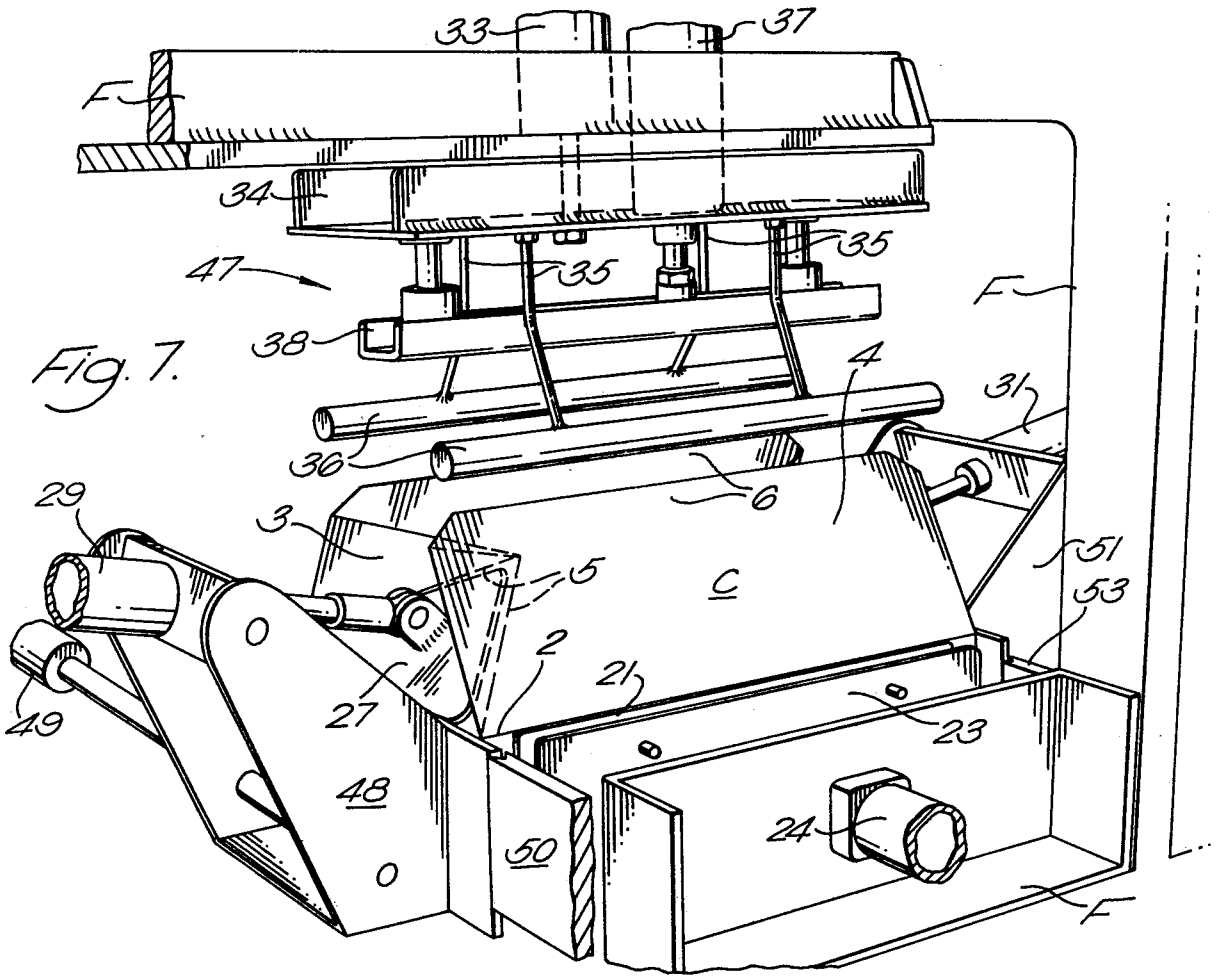

The invention is illustrated by way of example in the accompanying drawings in which, FIG. 1 is a perspective view of a knock-down carton of the type to which the invention applies prior to closure, FIG. 2 is a perspective view of the carton of FIG. 1 after closure, FIG. 3 is a schematic side elevation of an installation incorporating the apparatus of the invention, FIG. 4 is a schematic plan view corresponding to FIG. 3, FIG. 5 is an end elevation, on an enlarged scale, of the apparatus for closing one end of a carton (hereinafter referred to as the bottom closure apparatus), FIG. 6 is a perspective view of the apparatus for closing the other end of the carton (hereinafter referred to as the top closure apparatus), and FIG. 7 is a perspective view, corresponding in part to FIG. 6, showing parts of the apparatus in different positions.

Referring to FIGS. 1 and 2 of the drawings, the knock-down carton C to which the present invention applies comprises a rectangular sleeve having lengthwise corner creases 1 so that the sleeve can normally be stored in a flat condition. Each end portion of the sleeve is formed with crease lines 2 to present two pairs of end closure walls or flaps 3 and 4. The pair of walls 3 are each further provided with angularly disposed crease lines 5 to present, when the carton end is formed, gussets. Furthermore, the pair of walls 4 are each further provided to project, at 6, beyond the walls 3. In forming an end closure, the walls 3 are pushed inwardly towards each other to form the gussets and the projection 6 of one wall 4 is forced under the projection 6 of the other wall 4 where the two overlapping projections are glued together to provide an end closure. Since the end closure is formed from a continuous end portion of the sleeve, it is leakproof.

Referring now to FIGS. 3 and 4 of the drawings, there is shown an installation for erecting, filling and closing the ends of a carton as described with reference to FIGS. 1 and 2. The installation comprises a storage rack 7 to receive carton blanks C in their flat condition. Mounted adjacent the rack 7 is a pusher device 8 having a main pusher plate 9 connected to a main piston /cylinder unit 10 and a secondary pusher plate 11 connected to a secondary piston/cylinder unit 12 supported on the main pusher plate 9.

Extension of the piston/cylinder unit 10 causes a carton blank to be slid, between lower and upper guide rails 13 and 14, into an erection unit 15. The piston/cylinder unit 10 is then retracted. The erection unit 15 includes a stationary vacuum-operated gripping device 16 and a movable vacuum-operated gripping device 17 which is swingable through 90° as can be seen in FIG. 4. With the movable gripper device 17 in the position shown in chain dot lines, the devices 16 and 17 are operated to grip respectively two opposite side walls of the carton blank. At this point, the device 17 is swung into its solid line position and thereby erects the carton. As the carton is moved into its erected position, the opposite side thereof is moved into engagement with a second set of lower and upper guide rails 13 and 14. At the same time, the leading end of the lowermost projection 6 of one wall 4 of the carton comes into contact with a pair of adhesive nozzles 18 which are fed with adhesive from an adhesive reservoir 19.

After erection of the carton, the gripping devices 16 and 17 are rendered inoperative and the piston/cylinder unit 10 is extended to the position shown in chain dot lines and pushes the erected carton into a bottom closure apparatus 20. During this movement, the unit 10 also slides the next carton into the erection unit 15. Also during this movement, adhesive is applied over the full length of the projection 6.

In the bottom closure apparatus 20, the erected carton is supported by the lower and upper guide rails 13 and 14. The apparatus includes, on each side of the carton, a side gripping plate 21 which is resiliently mounted, via springs 22, on a support plate 23 mounted on a piston/cylinder unit 24. The units 24 enable the gripping plates 21 to be moved inwardly towards each other to grip opposite side walls of the carton. In addition, a reaction plate 25, which is supported on a piston/cylinder unit 26 mounted on a frame part F, is positioned above the erected carton. During the bottom closing operation, the reaction plate 25 is moved into the position shown in chain dot lines in FIGS. 3 and 5 under the action of the piston/cylinder unit 26.

The apparatus 20 further includes a first triangular pressure plate 27 which is hingedly mounted along one side edge to a stationary table 39. A stop plate 28 is also arranged adjacent the leading end of the erected carton C. The pressure plate 27 is movable, about its hinge, towards the carton under the action of a piston/cylinder unit 29. A second triangular pressure plate 30 is hingedly mounted, along one side edge, to the lower edge of the main pusher plate 9 of the pusher device 8. The pressure plate 30 is movable, about its hinge, towards the carton under the action of a piston/cylinder unit 31.

The apparatus 20 also includes, at a position below the erected carton C, a closure mechanism 32 which comprises a main piston/cylinder unit 33 mounted on a frame part F and supporting an elongated channel-shaped bracket 34. The bracket 34 supports, via angled arms 35, a pair of spaced apart longitudinally extending pressure rods 36. Also supported on the bracket 34, via a piston/cylinder unit 37, is an elongated pressure bar 38.

In order to effect bottom closure, the side gripping plates 21 and the reaction plate 25 are in their operative positions as described above. The triangular pressure plates 27 and 30 are then pivoted inwardly approximately 45° under the action of their piston/cylinder units 29 and 31. The plates 27 and 30 press against the triangular portions of the respective end closure walls or flaps 3 and force them inwardly so that partial bending takes place at the fold lines 2 and 5. This inward bending of the end closure walls 3 causes the end closure walls or flaps 4 also to bend inwards about the respective fold lines 2 thereof. In this position, as is shown in FIG. 5, the piston/cylinder unit 33 is extended to move the pressure rods 36 into a first operative position shown in broken lines where they engage and hold the respective end closure walls 4. The triangular pressure plates 27 and 30 are then returned, by their respective piston/cylinder units, to their inoperative positions. The pressure rods 36 are then moved into a second operative position shown in chain dot lines and this movement causes the projection 6, to which adhesive has been previously applied, to tuck under and overlap the other projection 6. In this respect, to ensure that the correct projection 6 is tucked in, one of the pressure bars 36 is positioned above the level of the other bar 36 as can clearly be seen in FIG. 5. At the same time, the gussets in the other closure walls 3 are fully formed.

It will be appreciated, as can be seen in FIG. 5, that the pressure bar 38 travels with the rods 36 during the aforementioned movements. After the tucking-in process, the piston/cylinder unit 37 is extended to move the pressure bar 38 into engagement with the overlapping projections against the reaction of the plate 25 thereby compressing the joint. This completes the bottom closure operation and the reaction plate 25, the closure mechanism 32 and the side gripping plates 21 are then withdrawn to their inoperative positions. At this stage, the secondary piston/cylinder unit 12 is extended and causes the secondary pusher plate 11 to push the carton C out of the bottom closure apparatus onto the stationary table 39 which has an elongated upstanding projection 40 coincident with the position of bottom closure joint. In this position, the uppermost edges of the walls 4 of the carton are still in engagement with the upper guide rails 14 which serve to compress the bottom closure joint onto the projection 40.

The previously described operations are repeated to effect the bottom closure of a second carton. When the second carton is pushed onto the table 39 it pushes the first carton from the table 39 onto a non-driven conveyor 41. The conveyor 41 comprises a series of closely spaced rollers 42 each having a centrally disposed annular projection 43 which is coincident with the position of the bottom closure joint. Here again, the joint is compressed onto the annular projections 43 by virtue of the fact that the uppermost edges of the carton are held in the upper guide rails 14. The length of the conveyor 41 is such that cartons are retained thereon for a period which is sufficient to allow setting of the adhesive.

At the end of the conveyor 41, the cartons are pushed onto a driven conveyor 44 where they are moved into a filling position indicated by a hopper 45. The filling means may be any conventional means to suit requirements and the filling material.

After being filled, a carton C is moved onto a second driven conveyor 46 by which it is carried into a top closure apparatus 47. The apparatus 47 is generally similar to the bottom closure apparatus 20 except that the closure mechanism 32 is reversed, i.e. it depends downwardly from frame parts F. Therefore, where applicable, the same reference numerals will be used for corresponding parts. Furthermore, since the material in a filled carton provides a reaction surface, the top closure apparatus 47 does not include a reaction plate 25.

In the top closure apparatus 47, the triangular pressure plate 27, and its co-acting piston/cylinder unit 37, are mounted on a bracket 48 which is slidable into and out of the path of movement of a carton C by means of a piston/cylinder unit 49. A stop member 50 is provided to accurately position the brakcet 48, and thus the triangular pressure plate 27, during the top closure operation. Similarly, the triangular pressure plate 30, and its co-acting piston/cylinder unit 31, are mounted on a bracket 51 which is slidable into and out of the path of movement of a carton C by means of a piston/cylinder unit 52. In this respect, as can be seen in FIG. 4, movement of the bracket 48 is perpendicular to the path of movement of the carton, whereas movement of the bracket 51 is at an angle to said path of movement. Also, a stop member 53 is provided to position the bracket 51.

The top closure apparatus 47 operates as follows. With the bracket 48 in the operative position as shown in the drawings, and the bracket 51 in a retracted or inoperative position, the conveyor 46 moves a filled carton C into the apparatus and stops at a position where the carton is up against the bracket 48. During this movement, the projection 6 of one of the end closure walls 4 has adhesive applied thereto by nozzles 54 supplied with adhesive from a reservoir 55. In this position of the carton, the bracket 51 is moved, under the action of its piston/cylinder unit 52, into its operative position as shown in the drawings. In this respect, since the bracket 51 is moved into engagement with the carton at an angle, it tends to ensure that the carton is properly positioned, and it also takes up any inaccuracies in the shape and sizing of the carton. The side gripping members 21 are then moved inwards to grip the carton and the apparatus is then in the position shown in FIG. 6.

At this stage, the triangular pressure plates 27 and 30 are pivotted inwardly to push the triangular portions of the end closure walls 3 towards each other, and also to cause the end closure walls 4 to move inwardly. This position is shown in FIG. 7 of the drawings. Thereafter, the closing mechanism 32 operates in the manner hereinbefore described with reference to the bottom closure operation to complete the top closure. The side gripping members 21 are then released, and the brackets 48 and 51 retracted into their inoperative positions. The conveyor 46 is started up to move the closed carton out of the apparatus 47 and, during this movement, the closed moves under a fixed pressure bar 56 which holds the top closure down after it leaves the pressure bar 38.

The closed carton passes from the conveyor 46 into a compression unit 57. The unit 57 comprises a lower driven conveyor 58 and an upper non-driven conveyor 59. The conveyor 58 and 59 are vertically spaced from one another to receive the closed carton in such manner that, during passage through the unit 57, the lower and upper closure joints are compressed for a period of time which is sufficient to allow adhesive to set.

The carton or case hereinbefore described can be used for transporting products which require no further packing but which are such that a conventional carton or case would not be suitable, for example powders, granules and semisolid liquids such as treacles, pastes or the like. However, in addition, by modifying the machine to provide spraying means in association with the reaction plate 25 which coat the interior of the carton or case with a plastics material, the case or carton could be used to carry a more liquid type of product.

We claim:

1. Apparatus for closing knock-down cartons of the type having, at each end thereof in continuation of each other, two oppositely disposed side wall flaps and two oppositely disposed end wall flaps having crease lines defining triangular portions to provide gussets, the apparatus comprising a pair of oppositely disposed carton side gripping devices each having a resiliently mounted gripping plate supported for movement towards and away from said carton side, a pair of oppositely disposed triangular pressure plates each hingedly mounted on a support, each support also having mounted thereon means for angularly moving the respective one of said triangular pressure plates into engagement with said triangular portions of said end wall flaps to partially fold inwardly said end wall flaps and said side wall flaps, a pair of pressure rods fixedly spaced apart movable in unison linearly into engagement with said partially folded-in side wall flaps to further fold inwardly said side and end flaps so that the free ends of said side flaps are in overlapping engagement, and a pressure bar movable relative to and in the same direction as said pressure rods and between said pressure rods while said pressure rods continue to engage said side wall flaps into engagement with said overlapping free ends of said side flaps along a previously applied line of adhesive.

2. Apparatus as claimed in claim 1, in which one of said pressure rods is positioned to engage one of said side wall flaps in advance of the other of said pressure rods engaging said other of said wall flaps.

3. Apparatus as claimed in claim 2, including a reaction plate which is supported for movement into and out of a position within the carton where it co-acts with said pressure bar.

4. Apparatus as claimed in claim 1, in which said support for one of said pair of pressure plates comprises a fixed structure.

5. Apparatus as claimed in claim 4, in which said support for the other of said pressure plates of said pair comprises a pusher plate which is movable towards and away from said fixed structure.

6. Apparatus as claimed in claim 1, in which cartons being formed move longitudinally through the apparatus and said support for each of said pressure plates comprises a bracket which is transversely slidable into and out of an operative position where each of said pressure plates is in the line of movement of a carton along a longitudinal path through the apparatus.

7. Apparatus as claimed in claim 6, in which said movement of each of said brackets transversely into and out of of an operative position is effected by means of a separate piston/cylinder unit.

8. Apparatus as claimed in claim 7, in which said two piston/cylinder units are disposed at an angle to one another.

9. Apparatus as claimed in claim 7, in which said two piston/cylinder units are disposed at an angle to one another, one of said piston/cylinder units being disposed normal to said longitudinal path and the other of said piston/cylinder units sloping towards said longitudinal path generally in the direction of carton movement.

10. Apparatus as claimed in claim 1 wherein said pressure rods are carried by a first movable support, and said pressure bar is carried by a second movable support carried by said first movable support wherein said pressure bar can first move in unison with said pressure rods and then independently of said pressure rods.

11. Apparatus as claimed in claim 10 wherein said second movable support is a fluid cylinder.

* * * * *